US007165695B2

(12) United States Patent
Choi

(10) Patent No.: US 7,165,695 B2
(45) Date of Patent: Jan. 23, 2007

(54) DISPENSING CONTAINER FOR DISPENSING FASTENERS

(75) Inventor: Kwang Ho Choi, Upper Saddle River, NJ (US)

(73) Assignee: Primesource Building Products, Inc., Jefferson, LA (US)

( * ) Notice: Subject to any disclaimer, the term of this patent is extended or adjusted under 35 U.S.C. 154(b) by 219 days.

(21) Appl. No.: 10/639,023

(22) Filed: Aug. 11, 2003

(65) Prior Publication Data

US 2005/0072783 A1 Apr. 7, 2005

Related U.S. Application Data

(60) Provisional application No. 60/446,431, filed on Feb. 11, 2003.

(51) Int. Cl.
*B65D 51/20* (2006.01)

(52) U.S. Cl. ..... 220/258.2; 220/254.3

(58) Field of Classification Search ..... 220/258.2, 220/335, 254.3–254.6, 259.2; 222/480, 151, 222/483, 543

See application file for complete search history.

(56) References Cited

U.S. PATENT DOCUMENTS

| | | | | | |
|---|---|---|---|---|---|
| 1,354,211 | A | * | 9/1920 | Reed | 206/38 |
| 3,262,606 | A | * | 7/1966 | Waterman | 222/480 |
| 3,737,066 | A | | 6/1973 | Ames | |
| 4,366,915 | A | | 1/1983 | Seidler | |
| 4,369,901 | A | * | 1/1983 | Hidding | 222/480 |
| 4,881,668 | A | | 11/1989 | Kitterman et al. | |
| 4,903,870 | A | * | 2/1990 | La Vange | 222/482 |
| 4,955,513 | A | | 9/1990 | Bennett | |
| 5,092,484 | A | * | 3/1992 | Daugherty et al. | 220/812 |
| 5,339,993 | A | * | 8/1994 | Groya et al. | 222/153.02 |
| 5,392,945 | A | | 2/1995 | Syrek | |
| 5,542,567 | A | * | 8/1996 | Julius | 221/63 |
| 5,636,732 | A | * | 6/1997 | Gilels et al. | 206/37 |
| 5,655,706 | A | | 8/1997 | Vandiver | |
| 5,673,811 | A | * | 10/1997 | Dickinson et al. | 220/812 |
| D385,791 | S | | 11/1997 | Forsyth et al. | |
| D448,295 | S | | 9/2001 | Mozes | |
| 6,308,870 | B1 | | 10/2001 | Samz et al. | |

* cited by examiner

*Primary Examiner*—Lien M. Ngo
(74) *Attorney, Agent, or Firm*—Garvey, Smith, Nehrbass & North, L.L.C.; Charles C. Garvey, Jr.

(57) ABSTRACT

A container is specially configured to enable a user to withdraw stored fasteners such as nails, screws, bolts, and the like. The device includes a receptacle base having a bottom wall and a continuous side wall that can be somewhat squared in shape. The receptacle base could be cylindrically shaped, oval shaped, or any other selected shape in plan view. A lid removably attaches to the side wall at the wall upper edge, the lid including a lid front section and a lid rear section. A hinge enables the front lid section to rotate about a hinge axis of rotation between closed an open positions. Each lid section has a raised portion that includes a plurality of inclined surfaces that define frictionally engaging correspondingly shaped socket and projecting portions that interlock when the front lid section is opened. An interference fit or frictional fit generated by the engaged socket and projecting portions holds the front lid section in the open position.

46 Claims, 4 Drawing Sheets

DISPENSING CONTAINER FOR DISPENSING FASTENERS

CROSS-REFERENCE TO RELATED APPLICATIONS

Priority of U.S. Provisional Patent Application Ser. No. 60/446,431, filed Feb. 11, 2003, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to containers for dispensing fasteners and like hardware items. More particularly, the present invention relates to an improved dispensing container that has particular utility in the dispensing of fasteners such as screws, bolts, nuts and the like. An improved two-part lid pivots one section with respect to the other, the two sections of the lid interlocking when a forward section reaches a fully open position so that the forward section of the lid remains open until a user has selected a desired number of fasteners that are contained in a lower, receptacle base part of the container.

2. General Background of the Invention

Many types of fasteners are sold in containers that hold typically dozens if not hundreds of fasteners. Such fasteners include wood screws, sheet metal screws, machine screws, bolts, nuts, washers, nails, tacks and the like.

The containers that hold fasteners need to be rugged to stand up to the relatively heavy weight of metal fasteners and their abrasive tendency when dozens or hundreds are contained within a single receptacle.

Several patents have issued for dispensing containers that have lids that can be moved between an open and a closed position, some of which lids have front and rear sections. The following table provides a listing of examples of such patents.

| PATENT NUMBER | TITLE | ISSUED DATE |
|---|---|---|
| 3,737,066 | Container Construction | Jun. 5, 1973 |
| 4,366,915 | Hinged Lid Container | Jan. 4, 1983 |
| 4,881,668 | Closure With Open Lid Retainer | Nov. 21, 1989 |
| 4,955,513 | Dispensing Closure With Flap Retention | Sep. 11, 1990 |
| 5,392,945 | Stackable Container For Premoistened Wipes | Feb. 28, 1995 |
| 5,655,706 | Resuable Top For Use With A Disposable Storage Container | Aug. 12, 1997 |
| 385,791 | Single Flap Push In Closure Over Catch | Nov. 4, 1997 |
| D448,295 | Plastic Closure | Sep. 25, 2001 |
| 6,308,870 | Apparatus For Covering A Container | Oct. 30, 2001 |

BRIEF SUMMARY OF THE INVENTION

The present invention provides a container having particular utility in the containing and dispensing of articles such as fasteners (for example, screws, bolts, nuts, washers, nails, tacks and the like).

The apparatus includes a receptacle base having a bottom wall and a continuous side wall with an upper edge. The side wall can include for example, four side walls that are integral.

A two part lid removably attaches to the side wall at the upper edge. The lid includes a lid front section and a lid rear section.

The front and rear lid sections are joined with a hinge that enables the front lid section to rotate about a hinge axis of rotation between closed and open positions.

Each lid section has a raised portion that includes a plurality of inclined, vertical or near vertical surfaces and a planar, transverse or flat, generally horizontal surface.

The inclined surfaces include at least a pair of inclined surfaces on each lid section that frictionally engage when the front lid section is rotated from the closed position to the open position. Once locked in an open position, frictionally engaged surfaces hold the front lid section open to form an angle of about 90 degrees with the other lid section.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
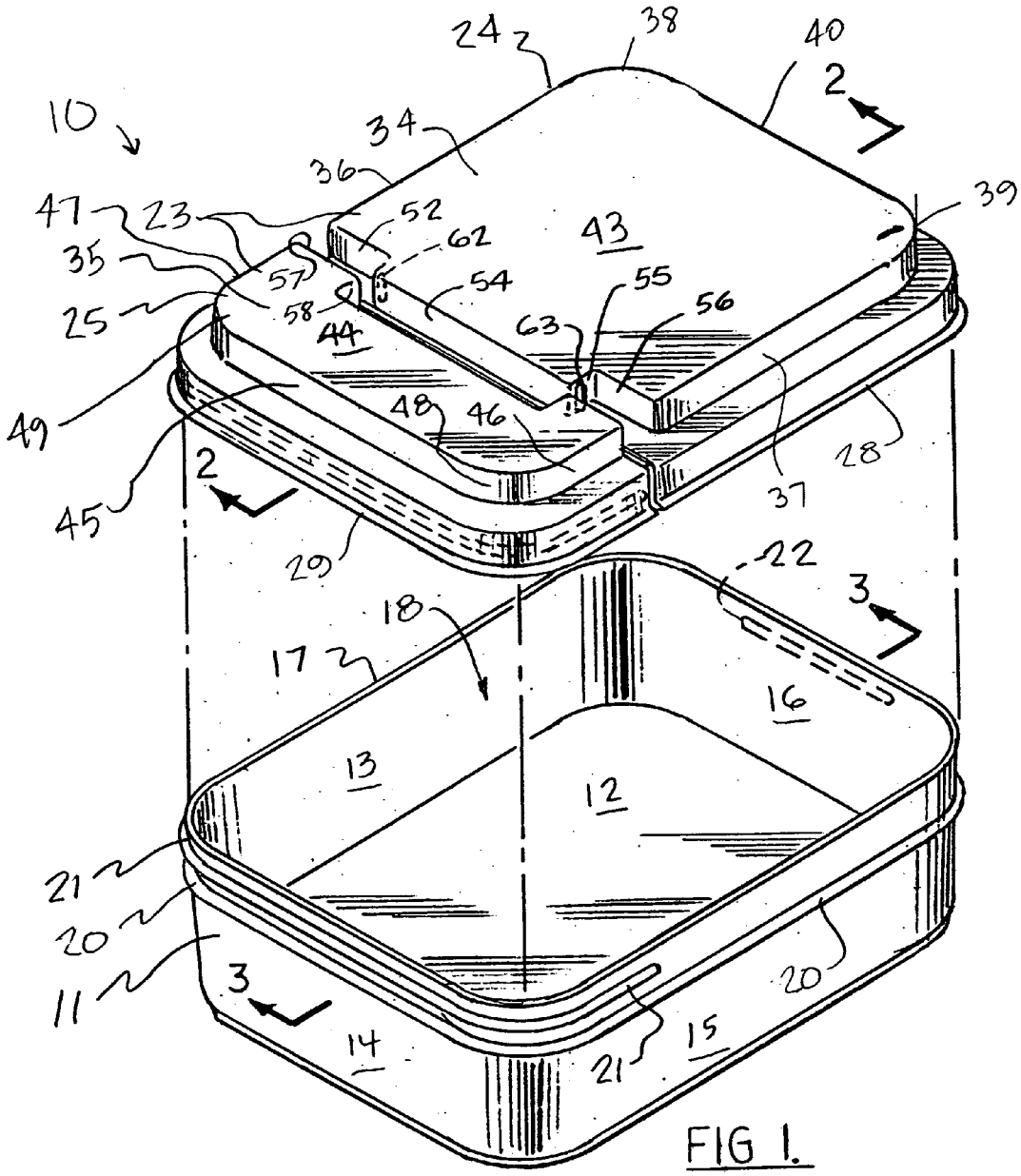
FIG. 1 is a perspective, exploded view of the preferred embodiment of the apparatus of the present invention.
Figure 2:
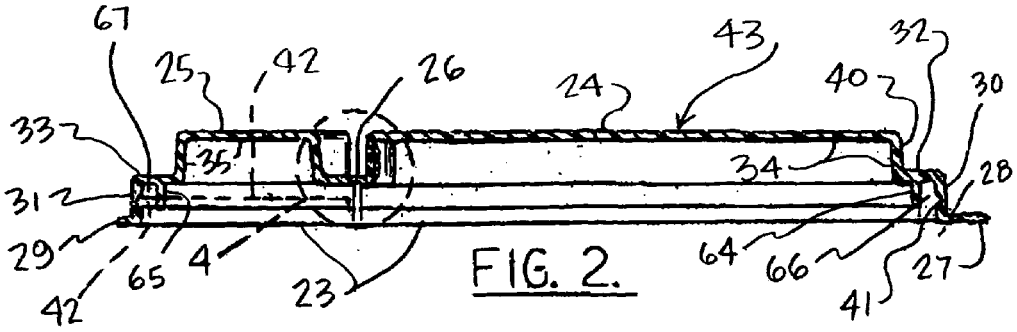
FIG. 2 is a sectional view taken along lines 2—2 of FIG. 1.
Figure 3:
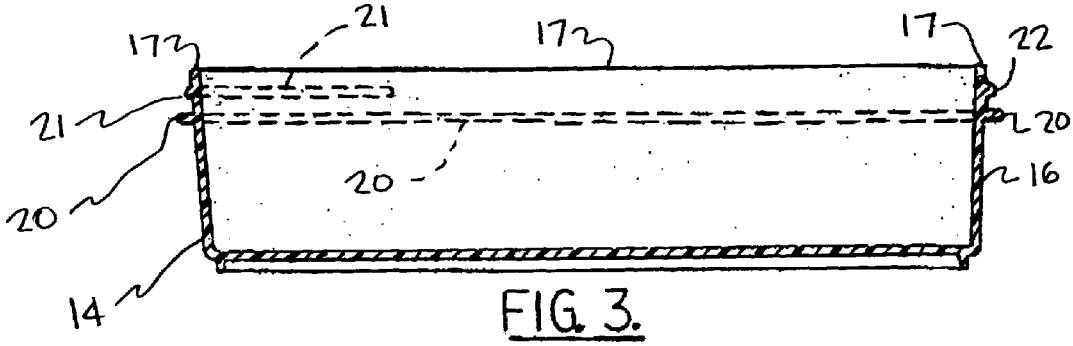
FIG. 3 is a sectional view taken along lines 3—3 of FIG. 1.

In FIGS. 1–8, the present invention provides a dispensing box container 10 that includes a receptacle base 11 and a lid 23.

The receptacle base 11 includes a bottom wall 12, and a continuous side wall having a plurality of flat side walls 13, 14, 15, 16. An upper edge 17 defines the top of each of the side walls 13–16. The lid 23 attaches to the receptacle base 11 by attaching to the top of the receptacle base 11 at upper edge 17. Receptacle base 11 is hollow, providing an interior 18 for holding a plurality of articles such as fasteners.

The bottom wall 12 can be provided with a continuous rib 19 that extends downwardly to define a foot or a ground engaging portion.

Peripheral flange 20 extends about the side walls 13, 14, 15 and 16 in a continuous fashion. In order to remove the lid 23, a user simply grips a portion of the peripheral flange 20 of receptacle base 11 while simultaneously gripping tab 27 (or peripheral flange 28) of lid 23 and pulls them apart.

The receptacle base 11 provides a pair of elongated beads 21, 22. The bead 21 is positioned at the rear 14 side wall of receptacle base 11. The bead 22 is positioned at the front side wall 16 of receptacle base 11. Each of the beads 21, 22 cooperates with a provided groove 41, 42 on the lid 23 so that a bead 21 or 22 of receptacle base 11 interlocks with a correspondingly sized and shaped groove 41 or 42 on lid 22. As will be described hereinafter, these grooves 41, 42 are mounted respectively on the front section 24 and rear section 25 of lid 23.

Figure 6:
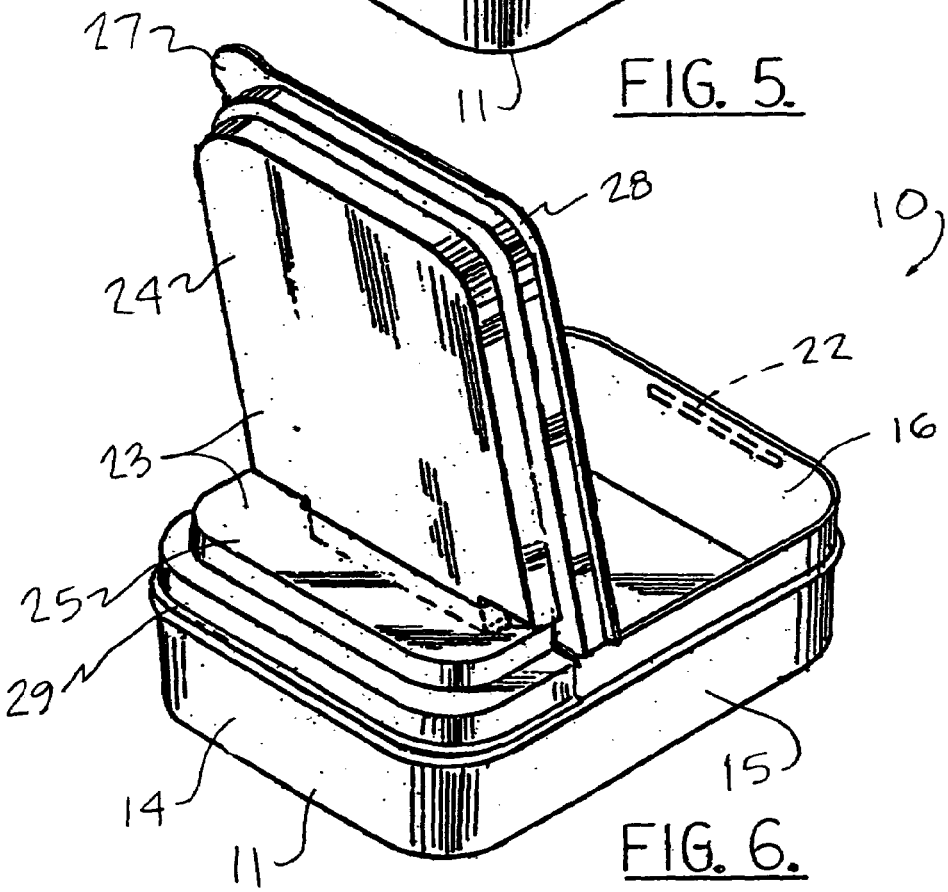
FIG. 6 is a perspective view of the preferred embodiment of the apparatus of the present invention with the lid in open position.
Figure 7:
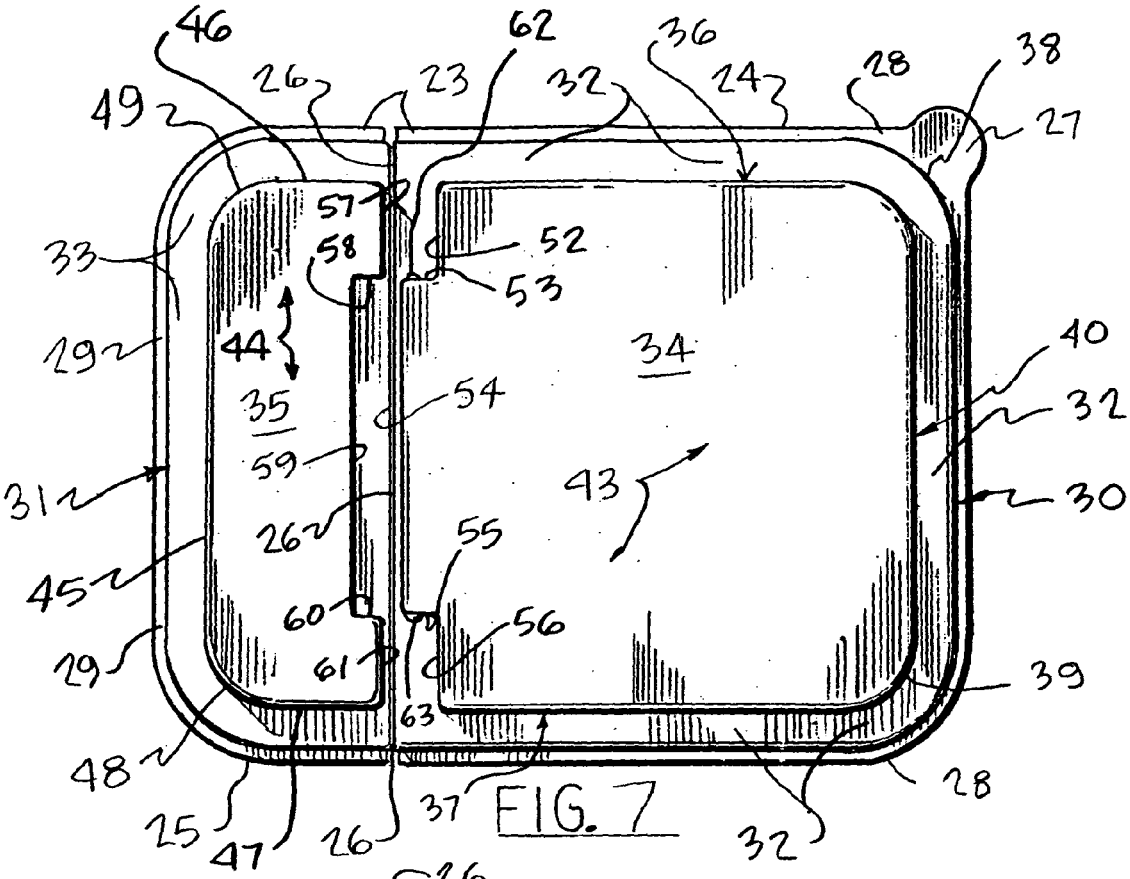
FIG. 7 is top view of the lid portion of the preferred embodiment of the apparatus of the present invention.
Figure 8:
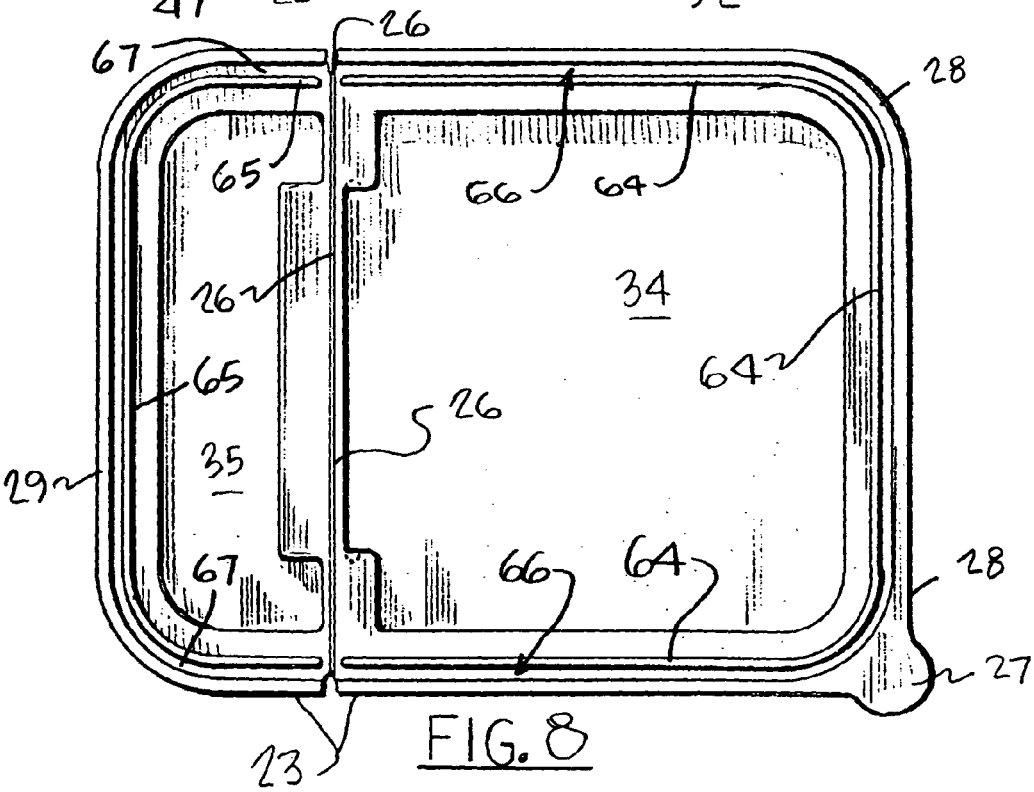
FIG. 8 is a bottom view of the lid portion of the preferred embodiment of the apparatus of the present invention.

In FIGS. 1, 2 and 4–6 lid 23 is a two part or two section lid 23 having front section 24 and rear section 25. Front section 24 is joined to rear section 25 at hinge 26. Each lid section 24, 25 has a peripheral flange. Front section 24 has peripheral flange 28 rear section 25 has peripheral flange 29. In order to assist a user in opening the front section 24 of lid 23, an opening tab 27 can be provided that extends away from peripheral flange 28 as shown in FIGS. 6 and 7-8.

Front section 24 of lid 23 has an inclined skirt 30 that is joined to horizontal section 32. The horizontal section 32 joins to inclined front wall 40. Similarly, rear section 25 of lid 23 has an inclined skirt 31 that is joined to horizontal section 33. The horizontal section 33 joins to raised lid portion 35. The raised lid portion 34 of front lid section 24 includes inclined side walls 36, 37, inclined curved corners 38, 39 inclined front wall 40 and upper planar panel 43. Each of these inclined portions 36–40 can be vertical or near vertical or inclined. Inclined as defined herein includes surfaces that are vertical, near vertical, or diagonally extending.

A groove 41 is provided on the inside surface of inclined skirt 30. The groove 41 interlocks with bead 22 when lid 23 is assembled to receptacle base 11. Similarly, groove 42 on rear section 25 interlocks with correspondingly sized and shaped rib 21 or receptacle base 11. A slot 66 is provided between sealing rib 64 and inclined skirt 30. When joining lid 23 to base 11, edge 17 occupies slot 66 at front lid section 24. Similarly, at rear lid section 25, edge 17 occupies slot 67 provided in between sealing rib 65 and inclined skirt 31.

The rear section 25 of lid 23 has raised portion 35 that includes planar upper panel 44, inclined rear wall 45, inclined side walls 46, 47 and inclined corners 48, 49.

An interlocking arrangement holds the front lid section 24 in an inclined, nearly vertical or obtuse position with respect to rear section 25 (as shown, e.g., at about 100 degrees open in FIG. 6) when a user rotates the front lid section 24 about hinge 26 and with respect to rear lid section 25. This fully opened position is shown in FIG. 6. A projecting portion 50 is provided on one of the lid sections 24, 25 and a receiving socket 51 is provided on the other of the lid sections 24 or 25. In the embodiment shown, projecting portion 50 is provided on forward section 24. However, the position shown in FIG. 5 of projecting portion 50 and socket 51 could be reversed so that the socket 51 is on the front section 24 and the projecting portion 50 is on the rear section 25.

Figure 4:
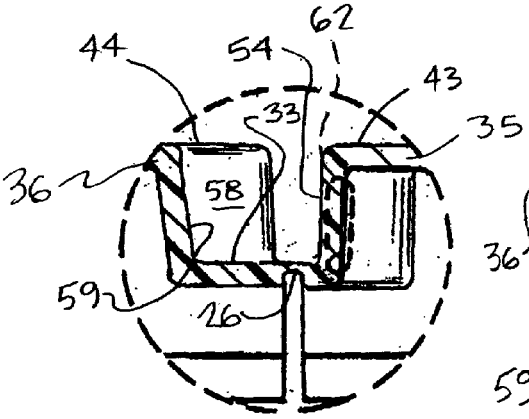
FIGS. 4–4A are fragmentary, sectional views of the preferred embodiment of the apparatus of the present invention.
Figure 4A:
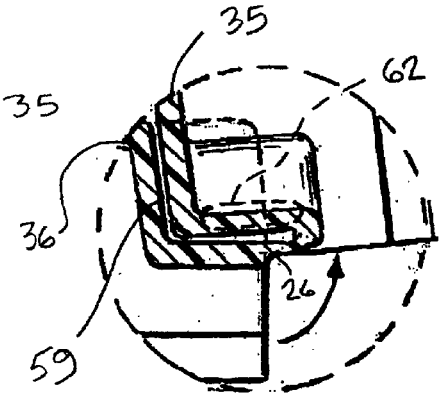
Figure 5:
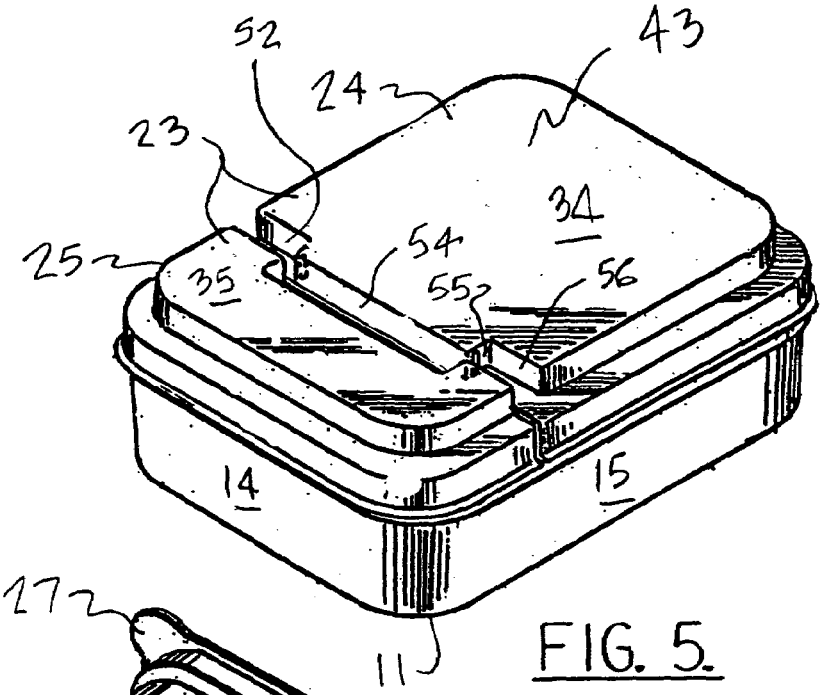
FIG. 5 is a perspective view of the preferred embodiment of the apparatus of the present invention with the lid in closed position.

Projecting portion 50 includes a portion of planar upper panel 43 and five inclined, vertical or near vertical panels 52–56. Socket 51 provides five inclined, vertical or nearly vertical panels 57–62. The surfaces 53 and 55 can carry ribs 63 and 64 to ensure a tight fit that will hold lid front section 24 in the open position of FIG. 6. These ribs 63, 64 create an interference fit with surfaces 58 and 60 of socket 51 when lid front section 24 is rotated from the closed position of FIGS. 1, 2, 4 and 7–8 to the position of FIGS. 4A and 6. This interference or frictional fit thus holds the front lid portion 24 in an open position when it is rotated to a position that engages the ribs 62, 63 with the surfaces 58, 60 and wherein projecting portion 50 occupies socket 51.

PARTS LIST

The following is a list of suitable parts and materials for the various elements of the preferred embodiment of the present invention.

10 dispensing box container
11 receptacle base
12 bottom wall
13 side wall
14 side wall
15 side wall
16 side wall
17 upper edge
18 interior
19 rib
20 peripheral flange
21 bead
22 bead
23 lid
24 front section
25 rear section
26 hinge
27 opening tab
28 peripheral flange
29 peripheral flange
30 inclined skirt
31 inclined skirt
32 horizontal section
33 horizontal section
34 raised lid portion
35 raised lid portion
36 inclined side wall
37 inclined side wall
38 inclined curved corner
39 inclined curved corner
40 inclined front wall
41 groove
42 groove
43 planar upper panel
44 planar upper panel
45 inclined rear wall
46 inclined side wall
47 inclined side wall
48 inclined corner
49 inclined corner
50 projection portion
51 socket
52 inclined panel
53 inclined panel
54 inclined panel
55 inclined panel
56 inclined panel
57 inclined panel
58 inclined panel
59 inclined panel
60 inclined panel
61 inclined panel

62 rib
63 rib
64 sealing rib
65 sealing rib
66 slot
67 slot The foregoing embodiments are presented by way of example only; the scope of the present invention is to be limited only by the following claims.

The invention claimed is:

1. A container for enabling a user to withdraw articles that are stored within the container, comprising:

a) a receptacle having a bottom and a plurality of side walls including at least a pair of opposed side walls with an upper edge;

b) a lid that removably attaches to the side wall at the edge, the lid including a lid front section and a lid rear section;

c) a hinge that extends from a position next to one side wall to a position next to the other side wall, the hinge enabling the front lid section to rotate about a hinge axis of rotation between closed and open positions;

d) each lid section having a raised portion that includes a plurality of inclined surfaces;

e) the inclined surfaces including at least a pair of inclined surfaces on each lid section that frictionally engage together when the front lid section is rotated from the closed position to the open position; and f) wherein the front lid section is attached to the upper edge in the closed position and is unattached from the upper edge in the open position.

2. The container for enabling a user to withdraw articles of claim 1 wherein the front lid section opens about ninety degrees.

3. The container for enabling a user to withdraw articles of claim 1 wherein the front lid section opens more than ninety degrees.

4. The container for enabling a user to withdraw articles of claim 1 wherein one of the lid sections is larger than the other lid section.

5. The container for enabling a user to withdraw articles of claim 1 wherein the hinge is closer to the rear of the lid.

6. The container for enabling a user to withdraw articles of claim 1 wherein the inclined surfaces are almost vertical.

7. The container for enabling a user to withdraw articles of claim 1 wherein the inclined surfaces are substantially vertical surfaces.

8. The container for enabling a user to withdraw articles of claim 1 wherein there are correspondingly shaped projecting and socket portion on the lid sections that interlock when one lid section is pivoted relative to the other lid section, wherein one lid section has a projecting portion and the other projecting portion having a socket.

9. A dispensing container, comprising:

a) a receptacle having a width, a bottom panel, an upper edge surrounding an open top, and a plurality of side walls including at least a pair of opposed side walls, the side walls extending between the bottom panel and the upper edge;

b) a lid that covers the open top of the receptacle, the lid including a front section, a rear section, and a hinge that extends laterally substantially the entire width of the receptacle, the hinge enabling the front lid section to rotate about a hinge axis between closed and open positions;

c) each lid section having a raised portion that includes a generally planar upper surface and flanges that extend downwardly from the planar surface; and d) a projecting portion on one raised section and a socket on the other raised section, and flanges on each raised section being frictionally engaged surfaces when the front lid section is moved to the open position.

10. The dispensing container of claim 9 wherein the socket has at least three sides.

11. The dispensing container of claim 9 wherein the projecting portion has at least three sides.

12. The dispensing container of claim 10 wherein two of the sides are longitudinal.

13. The dispensing container of claim 10 wherein three of the sides are transverse.

14. The dispensing container of claim 9 wherein one lid section is larger than the other.

15. The dispensing container of claim 9 wherein the projecting portion and socket form an interference fit when the projecting portion engages the socket.

16. The dispensing container of claim 9 wherein the lid has a peripheral flange for each lid section.

17. The dispensing container of claim 9 wherein the hinge defines a transverse axis of rotation and part of the projecting surface occupies a position behind said transverse axis when one lid section is opened.

18. The dispensing container of claim 9 wherein the projecting portion has one surface that is next to the axis.

19. A container, comprising:

a) a receptacle having a width, an open top, a bottom, a continuous side wall and an upper edge;

b) a lid that covers the open top of the receptacle by removably connecting to the upper edge of the receptacle, the lid including a front section, a rear section, and a hinge with a hinge axis, the hinge enabling the front lid section to rotate about the hinge axis between closed and open positions;

c) each lid section having a raised portion;

d) the raised portion of one lid section providing a three sided socket, the raised portion of the other lid section forming a three sided projection that is sized and shaped to fit the socket, at least a pair of flanges on each raised section being frictionally engaged surfaces when the front lid section is moved to the open position; and e) wherein the hinge extends laterally beyond the three sided socket and three sided projection.

20. The container of claim 19 wherein the sides of the socket are substantially vertical.

21. The container of claim 19 wherein the sides of the socket are near vertical.

22. The container of claim 19 wherein the sides of the socket are inclined.

23. The container of claim 19 wherein the sides of the projection are substantially vertical.

24. The container of claim 19 wherein the sides of the projection are near vertical.

25. The container of claim 19 wherein the sides of the projection are vertical.

26. The container of claim 19 further comprising ribs that extend away from at least one of the sides of a projection or a socket.

27. The container of claim 26 wherein there are two of said ribs.

28. The container of claim 26 wherein each lid section has a horizontal flange, a downwardly depending sealing flange that extends below the horizontal flange and the raised portions extend upwardly from the horizontal flange.

29. A container, comprising:

a) a receptacle having an interior, a bottom wall, a continuous side wall and an upper edge on the top of the side wall surrounding an open top;

b) a lid that covers the open top of the receptacle, the lid including a front section, a rear section, and a hinge with a hinge axis enabling the front lid section to rotate about the hinge axis between closed and open positions, wherein each lid section removably connects to the receptacle at the upper edge;

c) each lid section having a horizontal flange, a raised portion that extends up from the horizontal flange and vertical flanges that intersect the horizontal flange;

d) the raised portion of one lid section having a socket, the raised portion of the other lid section forming a projection that is sized and shaped to fit the socket, each of said projection and socket having a pair of surfaces that are frictionally engaged surfaces when the front lid section is moved to the opened position;

e) wherein the hinge extends laterally beyond the socket and projection; and f) wherein the lid front section is disconnected from the receptacle upper edge when the front lid section is placed in the open position.

30. A container, comprising:

a) a container base having a width, a bottom and a side wall with an upper edge;

b) a lid that removably connects to the container base at the upper edge, the lid including a front section and a rear section;

c) a hinge that connects the front section to the rear section;

d) a locking mechanism that hold the front section in an open position wherein the lid front section forms an angle of between about 45 and 135 degrees with the lid rear section;

e) the locking mechanism included a socket on one of the lid sections and a projecting portion on the other lid section, said socket and projection portions being defined by three raised surfaces on the front lid section, and three raised surfaces on the rear lid section;

f) the socket and projecting portions frictionally engaging when the front lid section is fully opened and the projecting portion registers in the socket portion, said frictional engagement holding the front lid section in the open position;

g) the hinge extending substantially the width of the container; and h) wherein the lid front section is disconnected from the receptacle upper edge when the front lid section is placed in the open position.

31. A container, comprising:

a) a container base having a bottom wall, a plurality of side walls, a width between opposed of the side walls, and an upper edge;

b) a lid that removably fits the container base at the upper edge, the lid including a larger front section that extends to the upper edge and a smaller rear section that extends to the upper edge;

c) the lid having upper and lower, vertically spaced apart flat surfaces that are connected with a plurality of generally vertically extending flanges d) a hinge having a width about equal to the container base width, the hinge connecting the front section to the rear section;

e) a locking mechanism that holds the front section in an open position that forms an angle of between about 45 and 135 degrees with the rear section;

f) the locking mechanism included a generally horizontally extending socket on one of the lid sections and a generally horizontally extending projecting portion on the other lid section that extends to a position next to the hinge, each of said socket and projection portions being defined by at least three flanges on the front lid section, and at least three flanges on the rear lid section;

g) the flanges of the socket and projecting portions frictionally engaging when the front lid section is fully opened and the projecting portion registers in the socket portion, said frictional engagement holding the front lid section in the open position.

32. The container for enabling a user to withdraw articles of claim 31 wherein the front lid section opens more than ninety degrees.

33. The container for enabling a user to withdraw articles of claim 31 wherein there are a plurality of projecting portions and a corresponding plurality of sockets.

34. The dispensing container of claim 31 wherein the projecting portion and socket form an interference fit when the projecting portion engages the socket.

35. The container for enabling a user to withdraw articles of claim 31 wherein the cover has a peripheral sealing structure that removably connects to the container base at the upper edge.

36. The container for enabling a user to withdraw articles of claim 35 wherein the flanges are spaced inwardly from the sealing structure.

37. The container for enabling a user to withdraw articles of claim 31 wherein the flanges and upper flat surface define a raised part of the lid that extends above the lower flat surface.

38. The container for enabling a user to withdraw articles of claim 37 wherein the flanges are spaced inwardly from the sealing structure.

39. The container for enabling a user to withdraw articles of claim 31 wherein at least one of the flanges engages a fiat surface when the lid front section is moved to the open position.

40. A dispensing container, comprising:

a) a receptacle having a bottom, a plurality of side walls and an upper edge and an open top;

b) a lid that covers the open top of the receptacle, the lid including a front section, a rear section, and a hinge that enables the front lid section to rotate about a hinge axis between closed and open positions;

c) each lid section having a raised section that includes a generally planar upper surface and flanges that extend downwardly from the planar surface;

d) a projecting portion on one raised section and a socket on the other raised section, and flanges on each raised section being frictionally engaged surfaces when the front lid section is moved to the opened position; and e) wherein the hinge defines a transverse axis of rotation and part of the projecting portion occupies a position behind said transverse axis of rotation when one lid section is opened.

41. The dispensing container of claim 40 wherein the socket has three sides.

42. The dispensing container of claim 40 wherein the projecting portion has three sides.

43. The dispensing container of claim 40 wherein one lid section is larger than the other.

44. The dispensing container of claim 40 wherein the projecting portion and socket form an interference fit when the projecting portion engages the socket.

45. The dispensing container of claim 9 wherein the lid has a peripheral flange for each lid section.

46. The dispensing container of claim 40 wherein the projecting portion has one surface that is next to the axis of rotation.

* * * * *